US006189991B1

(12) United States Patent
Wen et al.

(10) Patent No.: US 6,189,991 B1
(45) Date of Patent: Feb. 20, 2001

(54) COMPENSATING FOR RECEIVER SKEW AND CHANGING RESOLUTION IN INK JET PRINTER

(75) Inventors: Xin Wen; Henry G. Wirth, both of Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/133,879

(22) Filed: Aug. 14, 1998

(51) Int. Cl.[7] ..... B41J 29/38; B41J 2/155
(52) U.S. Cl. ..... 347/13; 347/42
(58) Field of Search ..... 347/40, 42, 12, 347/13, 14, 116

(56) References Cited

U.S. PATENT DOCUMENTS

| | | | | |
|---|---|---|---|---|
| 4,569,584 | * | 2/1986 | St. John et al. | 347/116 X |
| 4,739,415 | * | 4/1988 | Toyono et al. | 347/40 X |
| 5,229,791 | * | 7/1993 | Kuboki | 347/104 X |
| 5,598,196 | | 1/1997 | Braun . | |
| 5,815,173 | * | 9/1998 | Silverbrook | 347/59 X |

FOREIGN PATENT DOCUMENTS

| | | | | |
|---|---|---|---|---|
| 0 031 421 A2 | * | 7/1981 | (EP) | B41J/3/02 |
| 771 657 A2 | | 10/1996 | (EP) . | |

* cited by examiner

*Primary Examiner*—David F. Yockey
(74) *Attorney, Agent, or Firm*—Raymond L. Owens

(57) ABSTRACT

Ink jet printing apparatus for forming an ink image on a receiver in response to a digital image includes at least one moveable ink jet print bar which is adapted to deliver ink to the receiver at an image transfer position to print at least a portion of a line at a time across the width of the receiver. The receiver is moved along a path past the ink jet print bar at the image transfer position. A detector unit disposed adjacent to the path detects receiver skew relative to the ink jet print bar and producing a signal representative of the receiver skew. Alignment structure coupled to the print bar is responsive to the signal for adjusting the position of the print bar to compensate for receiver skew, and a control unit is responsive to the digital image after the ink jet print bar has been positioned for actuating the ink jet print bar to form an ink image on the receiver. The alignment structure may also position the print bar to change the image resolution.

10 Claims, 6 Drawing Sheets

COMPENSATING FOR RECEIVER SKEW AND CHANGING RESOLUTION IN INK JET PRINTER

CROSS REFERENCE TO RELATED APPLICATIONS

Reference is made to commonly assigned U.S. patent application Ser. No. 08/765,756, filed Dec. 3, 1996 entitled "Photographic Processing and Copying Systems" to Silverbrook and U.S. patent application Ser. No. 09/118,538, filed Jul. 17, 1998, entitled "Borderless Ink Jet Printing on Receivers" to Wen. The disclosure of these related applications is incorporated herein by reference.

FIELD OF THE INVENTION

The present invention relates to providing ink jet printing apparatus capable of compensating receiver skew and adjusting printing resolution.

BACKGROUND OF THE INVENTION

In recent years, great advancement has been realized in ink jet printing technologies. These printing techniques have the advantages of easy image manipulation, compatibility with digital image files, and potential faster turn-around time. When configured properly, ink jet printers can deliver images with qualities close to that of the traditional photographs. For digital photo printing in a minilab, printing productivity is crucial because a large number of photo images often need to be printed in a short period of time in a minilab. To use ink jet printers in such applications, it is desirable to have to a wide ink jet print head that can print a large number of image pixels on a receiver in one printing pass. The print head is preferably page-wide so that a photo image can be printed in a single pass.

Borderless print is a very desirable feature to photographic viewers. Borderless print refers to photographic images that are printed from edge to edge on a receiver. To provide borderless print by an ink jet printer, it is critical for the array of ink nozzles in the print head to be perfectly aligned with the edge of the ink receivers. Any skew in the receiver relative to the print head will result in oblique image borders at the edges of the receiver. The image defects thus produced include unprinted wedge margins and over printing out side of the receiver.

Another requirement in photo minilab is the capability of printing photographs at both different resolutions. This capability is needed because photographs are often viewed at different viewing distances. High image quality needs to be perceived for all applications. For example, a wallet-size (2" by 3") photograph needs to be printed at a higher resolution than that of an enlarged page-size (8" by 10") photograph because a wallet-size photograph is normally viewed at a closer distance than a page-size photograph.

SUMMARY OF THE INVENTION

An object of this invention is to provide photo-quality ink images on receivers.

Another object of this invention is to provide an ink jet printing apparatus capable of compensating for receiver skew.

A further object of this invention is to provide an ink jet printing apparatus capable of adjusting the printing resolution of the ink jet print bar according to the requirement of the ink image to be printed.

These objects are achieved by ink jet printing apparatus for forming an ink image on a receiver in response to a digital image, comprising:

a) at least one moveable ink jet print bar which is adapted to deliver ink to the receiver at an image transfer position to print at least a portion of a line at a time across the width of the receiver;

b) means for moving the receiver along a path past the ink jet print bar at the image transfer position;

c) detector means disposed adjacent to the path for detecting receiver skew relative to the ink jet print bar and producing a signal representative of the receiver skew;

d) alignment means coupled to the print bar and responsive to the signal for adjusting the position of the print bar to compensate for receiver skew; and e) control means responsive to the digital image after the ink jet print bar has been positioned for actuating the ink jet print bar to form an ink image on the receiver.

ADVANTAGES

An advantage of this invention is that image borders can be printed parallel to the receiver edges even when the receiver is skewed to the ink jet print bars. Specifically, borderless ink images can be achieved on the receiver in the presence of receiver skew.

Another advantage of this invention is that the printing resolution of the ink jet print bar can be varied so that the ink images can meet the needs of different applications.

A feature of this invention is that a movable ink jet print bar is adapted to deliver ink to the receiver at an image transfer position to print cross the width of the receiver.

Another feature of this invention is that a movable ink jet print bar is pivotally mounted at least one pivot position and the ink jet print bar can be rotated about the pivot position to compensate for receiver skew or to vary image resolution.

DETAILED DESCRIPTION OF THE INVENTION

The present invention is described with relation to an ink jet printing apparatus capable of compensating receiver skew and adjusting printing resolution.

Figure 1:
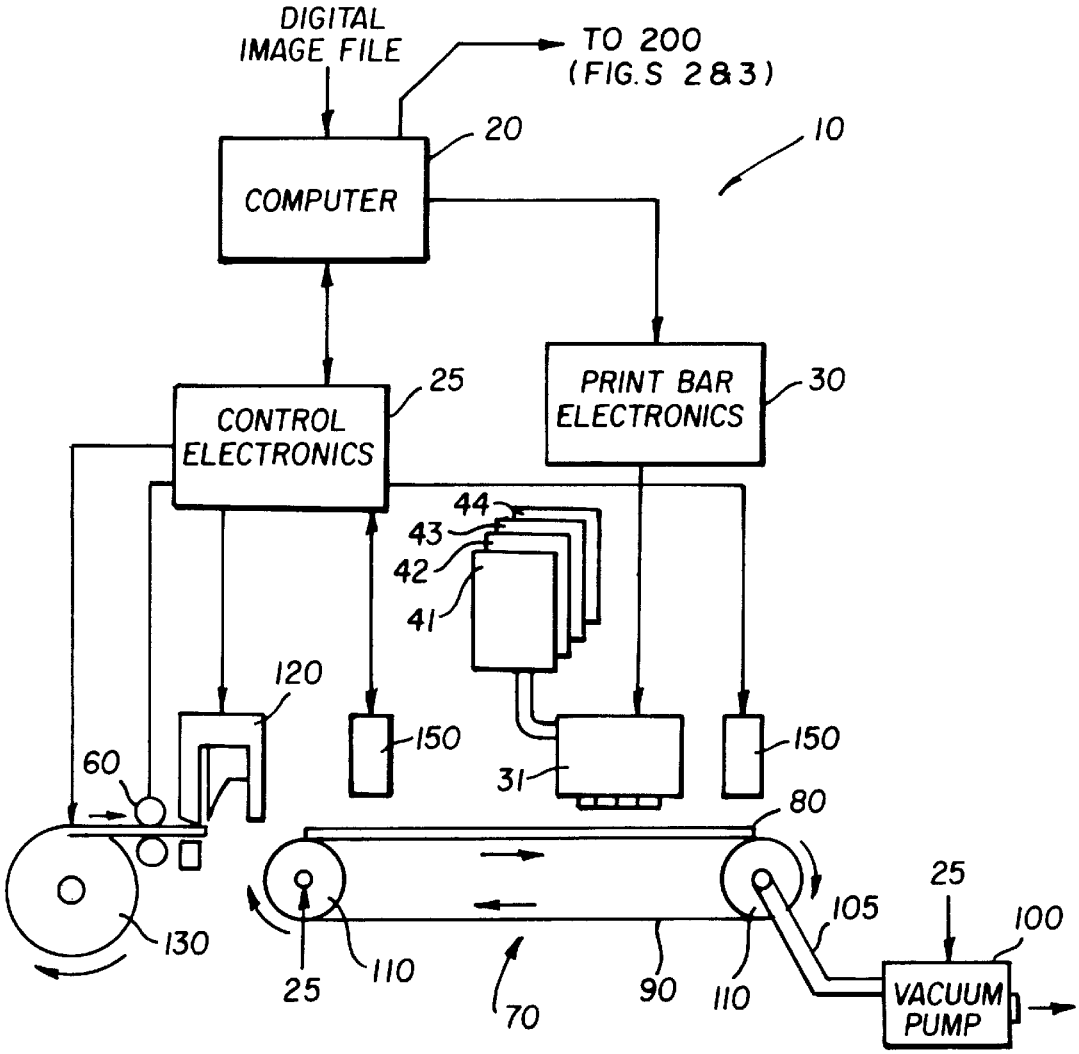
FIG. 1 is a schematic view of the ink jet printing apparatus in accordance with the present invention.

Referring to FIG. 1, an ink jet printing apparatus 10 comprises a computer 20, control electronics 25, print bar drive electronics 30, ink jet print bar 31, and a plurality of ink reservoirs 40–43 for providing the different colored inks to the ink jet print bar 31. The ink jet printing apparatus 10 further includes a receiver feed mechanism 60 for feeding a receiver 80 from a receiver roll 130 by a pair of capstan rollers. A receiver transport mechanism 70 transports the receiver 80 over a platen 90 to a image transfer position under the print bar 31. The platen 90 in FIG. 1 is shown in the form of a conveyance belt although many other platen types such as plate-bed or drum platens are also compatible with the present invention. The receiver 80 is held to the platen 90 by vacuum suction provided by a vacuum pump 100 via a vacuum tube 105. The vacuum pump 100 is under the control of the control electronics 25. No mechanical components are used to hold on the ink receiving side of the receiver 80. This permits the ink jet print bar 31 to print freely across the whole receiver 80 from edge to edge. The platen 90 is translated as a belt by platen transport rollers 110. The platen transport rollers 110 and the receiver transport mechanism 70 are both controlled by control electronics 25.

The ink jet print bar 31 includes a plurality of ink nozzles and associated ink drop activators for delivering different colored ink drops to the receiver 80. Preferably, the length of ink jet print bar 31 is across the full width of the receiver 80. The ink jet print bar 31 can be provided by an assembly of ink jet print bars or by linear arrays of ink nozzles on a monolithic nozzle plate and associated fluidic structure for each color ink. For the ink jet print bar 31 narrower than the width of the receiver 80, the ink image is composed of a plurality of printing swaths with each swath printed by one printing pass of the ink jet print bar. The ink drops can be ejected from the ink nozzles by the ink jet activation means well known in the art, for example, piezoelectric actuators or thermal electric actuators. Examples of ink jet print bars are shown in commonly assigned U.S. Pat. No. 5,598,196 and European Patent 771 657 A2, the disclosure of which is incorporated herein by reference.

Figure 2:
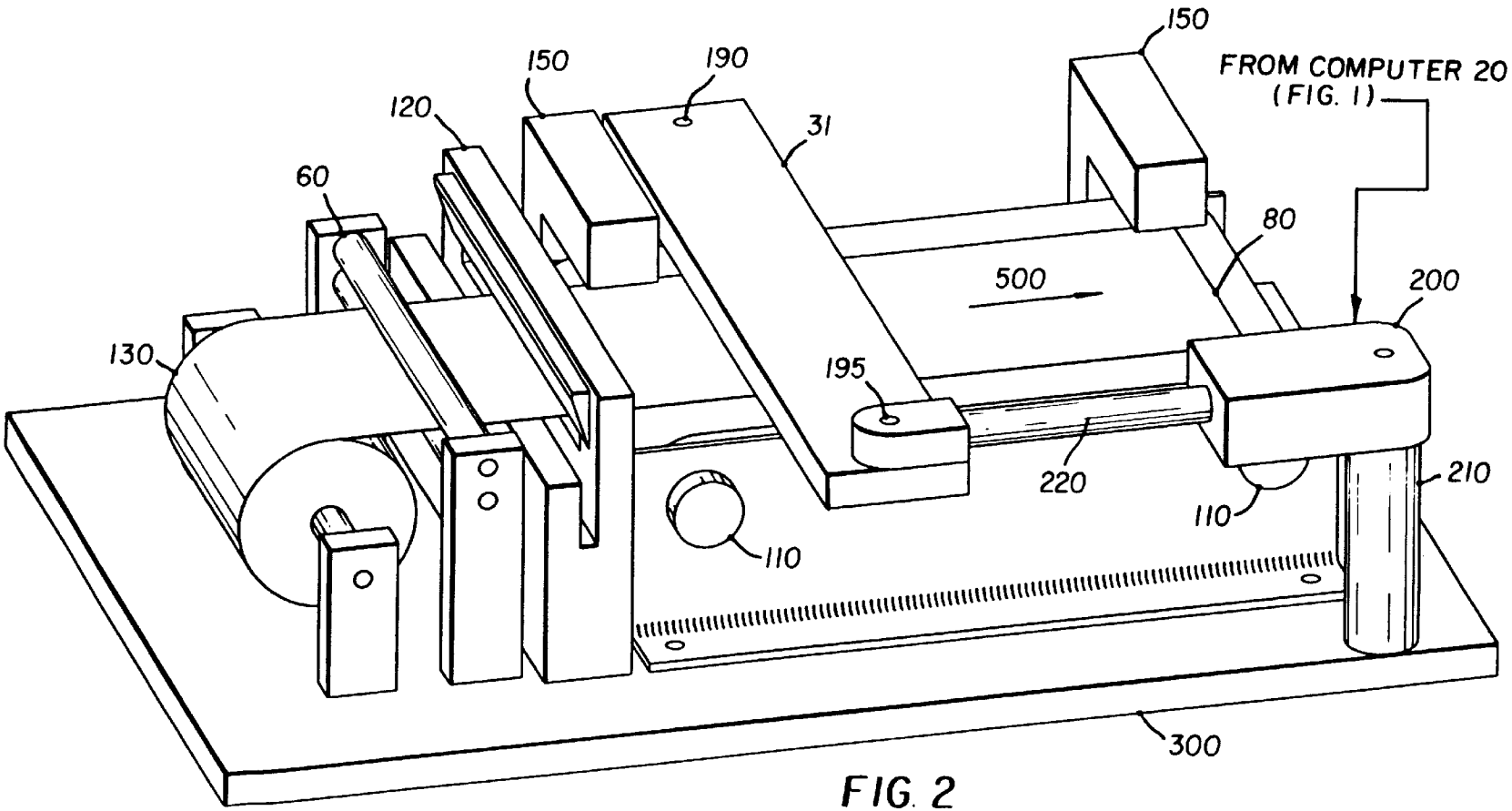
FIG. 2 is a partial perspective view of the ink jet printing apparatus of FIG. 1 in a configuration in which the print bar is adjusted perpendicular to the receiver transport direction.

Still referring to FIGS. 1 and 2, an ink jet printing apparatus 10 also includes a receiver cutter assembly 120. The cutting operation of the receiver cutter assembly 120 is controlled by control electronics 25. The receiver 80 can be cut before or after printing. The receiver 80 can be provided by receiver roll 130 in the form of a web, or alternatively, in the form of cut sheet. In FIG. 1, a receiver detection unit 150 is shown in bidirectional communication with the control electronics 25. The receiver detection unit 150 includes an image sensor (not shown) for detecting the position of the receiver edges. The image sensor is preferably an area image sensor such as a CMOS or a CCD imager. The receiver detection unit 150 can also include light source such a light emitting diode, a diode laser, or a fluorescent lamp. The receiver detection unit 150 receives commands from control electronics 25 for detecting receiver positions. The image sensor captures the image of the edges of the receiver 80. The receiver detection unit 150 sends an image signal to the control electronics 25 which in turn sends the image signal to the computer 20. The computer 20 processes the image data to determine the edge location of the receiver 80 and controls motor 200. The locations of the lead edge and side edges of the receiver 80 can be obtained in this fashion. The direction of the receiver 80 can include the detection and analysis of two or more locations along the side edge of the receiver 80. The skew of the receiver 80 is thus obtained. In the present invention, the word "skew" is defined as deviation in the direction of the receiver side edge from the receiver transport direction. In other words, it is a preferred direction that does not require adjustment of the print bar 31 to compensate for receiver skew.

FIG. 2 shows a partial perspective view of the ink jet printing apparatus of FIG. 1. The ink jet print bar 31 is pivotally mounted at a pivot position 190. An alignment structure permits the ink jet print bar 31 to be rotated about the pivot point 190 by motor 200 for compensating for the receiver skew or for changing ink image resolution on the receiver 80. The motor 200 is supported by support 210 and is connected to the ink jet print bar 31 through a connecting rod 220 and a connecting link 230. The connecting link 230 is pivotally connected to the ink jet print bar 31 at the pivot point 195. The ink jet print bar 31 is shown in FIG. 2 to be aligned perpendicular to the receiver transport direction 500.

The receiver 80 is transported by a receiver feed mechanism 60 from receiver roll 130. The receiver feed mechanism 60 includes a pair of capstan rollers which form a receiver nip. The receiver 80 passes through a receiver cutter assembly 120 which can cut the receiver 80 to appropriate sizes according to the digital image file. A side edge of the receiver 80 is detected by two receiver detection units 150. As described in relation to FIG. 1, the receiver detection units 150 can include area image sensors such as CCD or CMOS sensors to capture the image of the receiver edges for calculating the receiver skew. The receiver roll 130, the receiver feed mechanism 60 the receiver cutter assembly 120, the receiver detection units 150, the ink jet print bar 31, and the motor 200 are all supported on a base plate 300.

Figure 3:
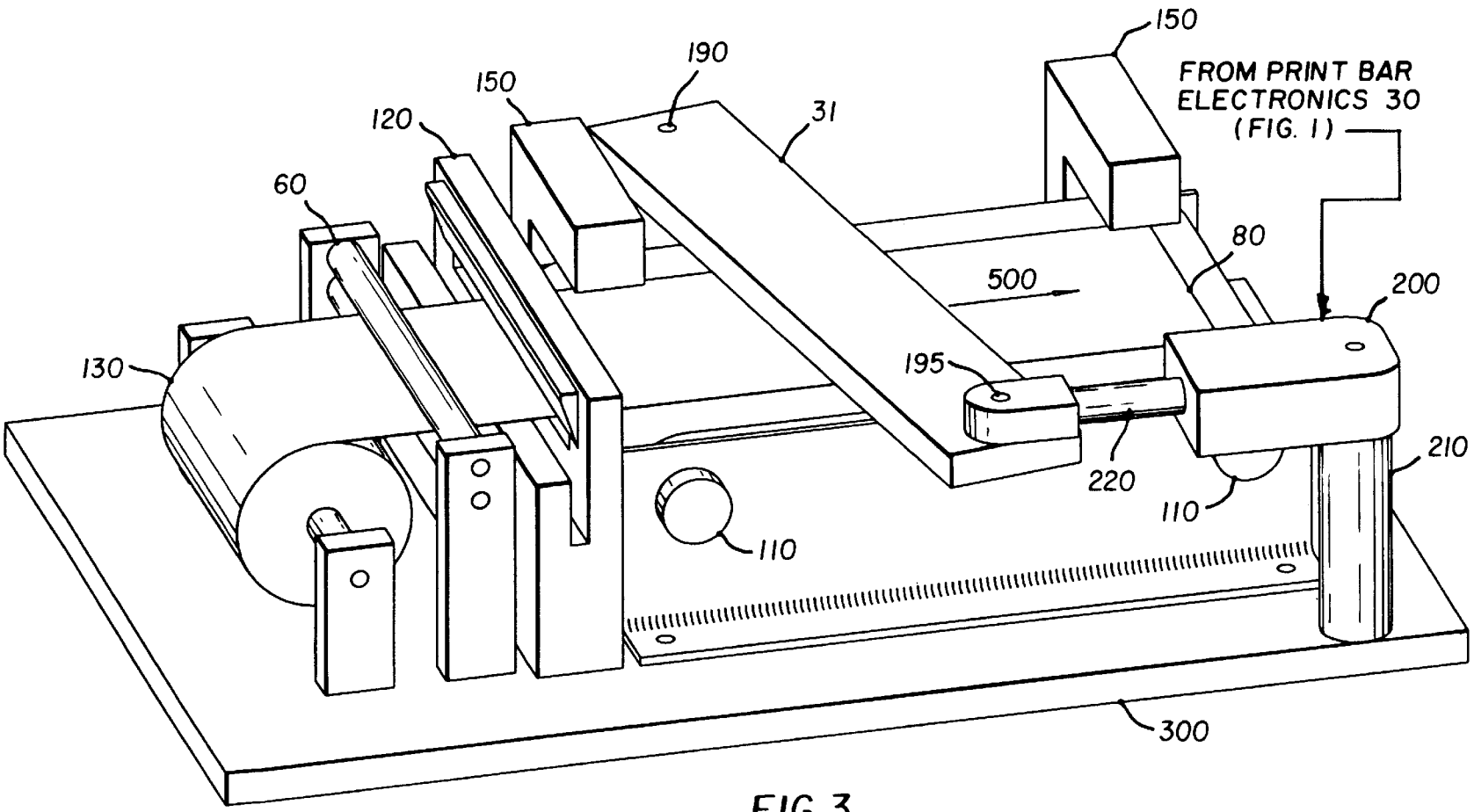
FIG. 3 is a partial perspective view of the ink jet printing apparatus of FIG. 1 in a configuration in which the print bar is adjusted oblique to the receiver transport direction.

FIG. 3 shows another partial perspective view of the ink jet printing apparatus of FIG. 1. The ink jet print bar 31 has been rotated around the pivot point 190 by motor 200 under control of computer 20 to an orientation that is oblique to the receiver transport direction. The amount of the rotation is determined for compensating the amount of the receiver skew (with the amount of rotation greatly exaggerated for illustration). The amount of the rotation can also be determined by the desired image resolution from the digital image file or user input, as described below in more detail.

Figure 4:
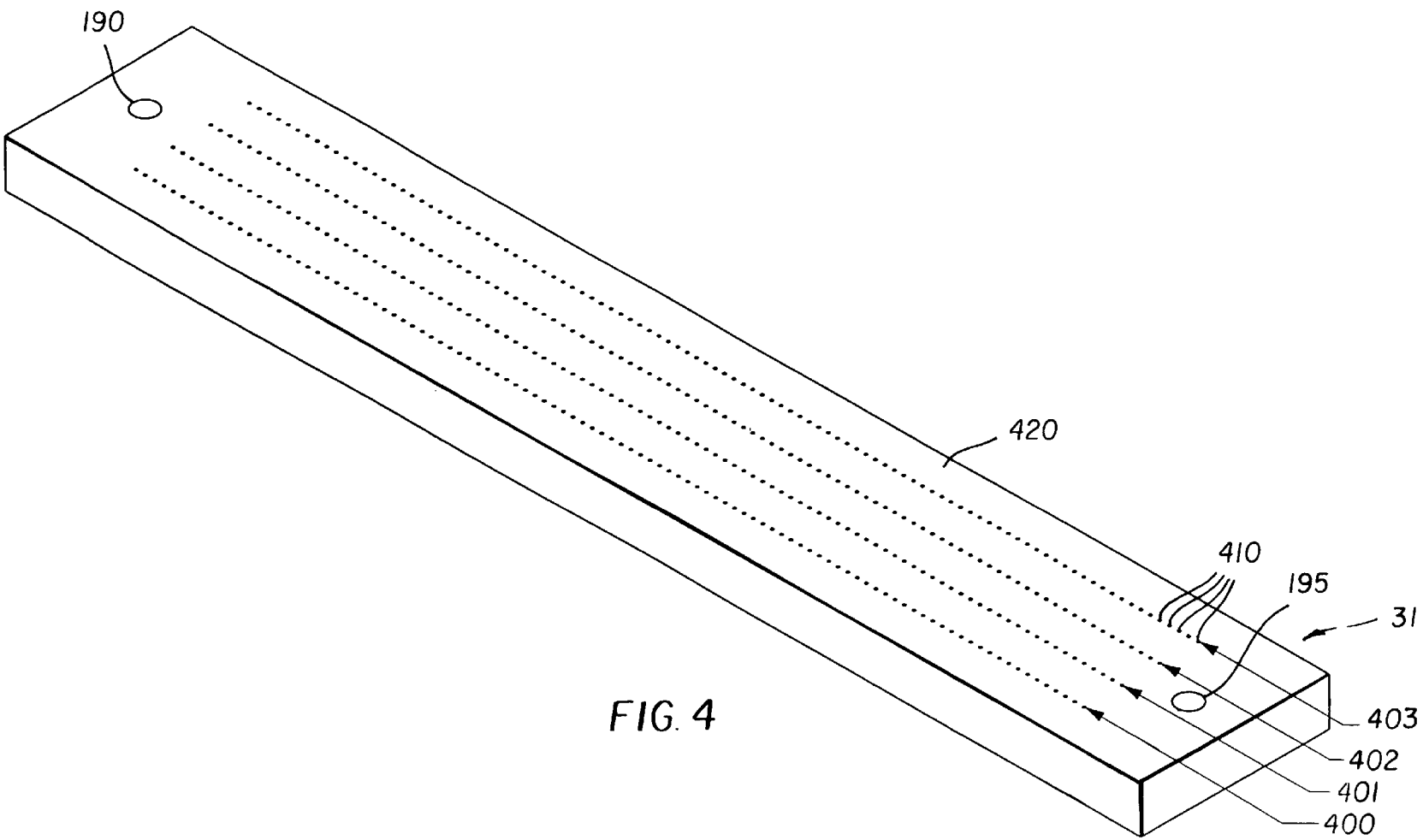
FIG. 4 is a partial perspective view of the ink jet print bar of the ink jet printing apparatus of FIG. 1.

FIG. 4 is a partial perspective view of the ink jet print bar 31 of the ink jet printing apparatus of FIG. 1. The ink jet print bar 31 includes four nozzle arrays 400, 401, 402, and 403, each having a plurality of ink nozzles 410, formed on the nozzle plate 420, which are facing the receiver 80 during printing. The nozzles 410 in the nozzle arrays 400, 401, 402, and 403 are respectively for printing yellow, magenta, cyan and black inks on the receiver 80. It is understood that the ink jet print bar 31 in accordance with the present invention is compatible with various ink nozzle configurations. For example, the ink jet print bar may comprise a plurality of smaller ink jet print heads each having a plurality of ink nozzles. The smaller ink jet print heads together can provide printing across the full width of the receiver. The ink nozzles 410 can also form in staggered or redundant configurations.

Figure 5:
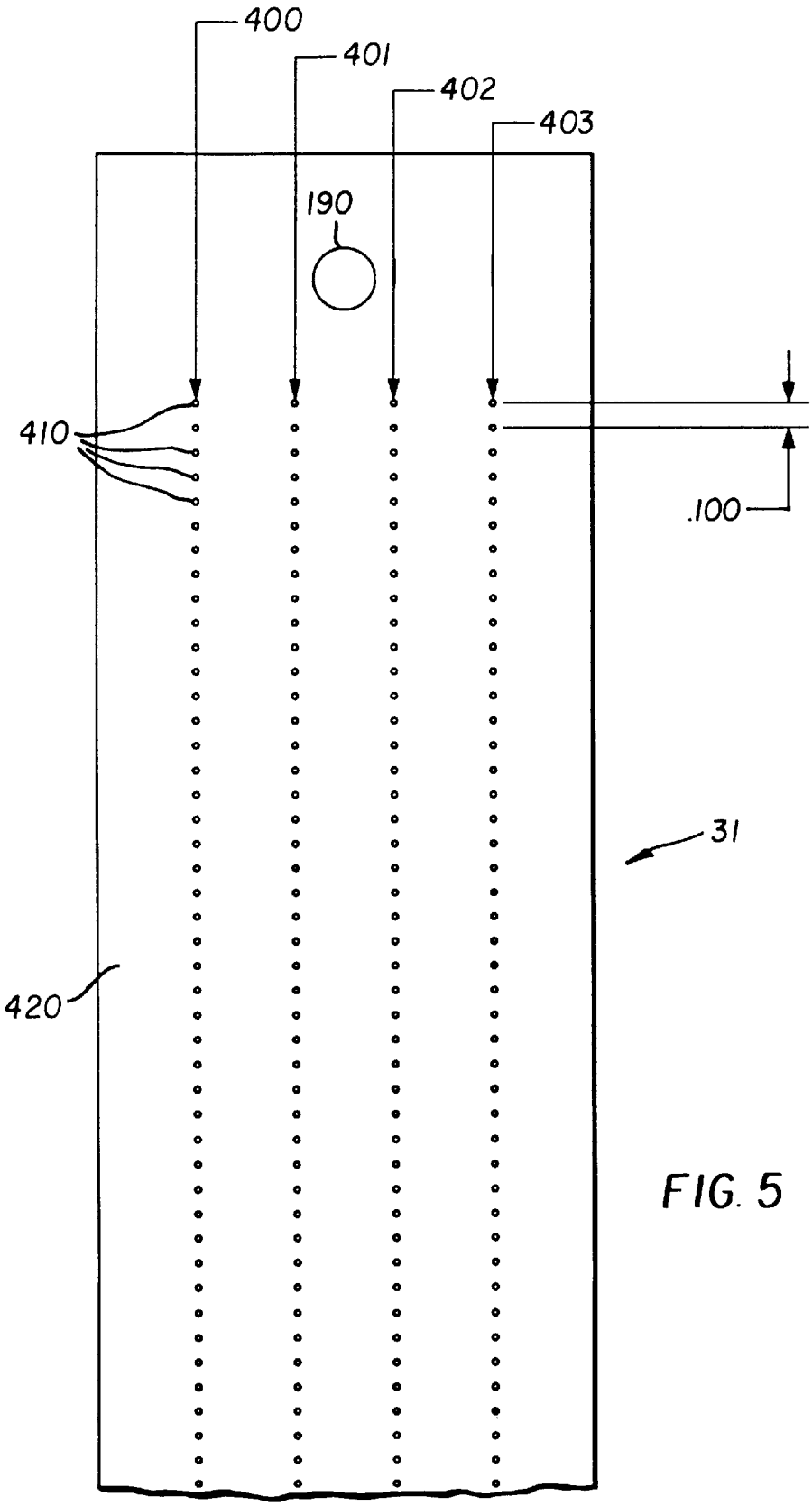
FIG. 5 is a partial top view of the ink jet print bar of FIG. 1 when the print bar is perpendicular to the receiver transport direction.

FIG. 5 is a partial top view of the ink jet print bar of FIG. 1. The ink jet print bar 31 is adjusted perpendicular to the receiver transport direction 500 (the x direction). For a photo minicab, it is desirable to print a photo image in a single printing pass. As shown, the image resolution of the printed photo image is defined by the inverse of the spacing between adjacent ink nozzles 410 for each colored nozzle arrays 400, 401, 402, and 403.

Figure 6:
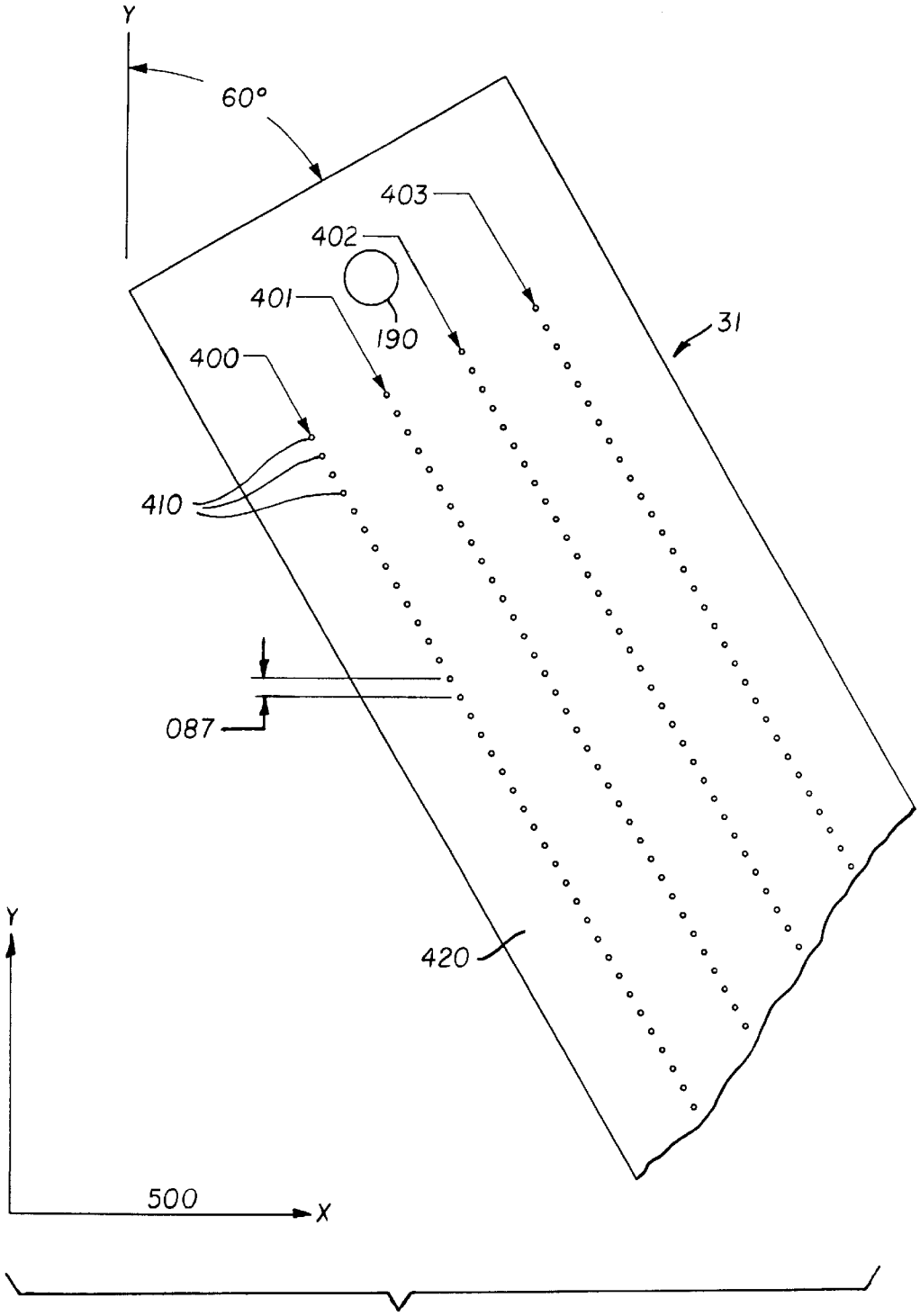
FIG. 6 is a partial top view of the ink jet print bar of FIG. 1 when the print bar is oblique to the receiver transport direction.

FIG. 6 shows a partial top view of the ink jet print bar 31 that is adjusted 30° oblique to the receiver transport direction 500 (the x direction). In this case, the image resolution of the printed photo image is determined by the increment of the adjacent nozzle spacing in the y direction. The image resolution is therefore increased by a factor of 1/cos(30°). Note that the ink jet print bar 31 is provided wider that the width of the receiver 80 so that an image can be printed across the full width for all desired orientations of the ink jet print bar 31. For the ink jet print bar 31 in a direction oblique to the receiver transport direction 500, the timing controlled by computer 20 of the actuation of the ink drops from the ink nozzles need to be properly adjusted so that a straight print line can be formed across the receiver 80. A user can input the desired resolution and the computer also will adjust the position of the ink jet print bar 31 to produce such resolution. The ink nozzles 410 in a nozzle array (e.g. nozzle array 400) need to be actuated in sequence according to the positions of the ink nozzles along the receiver transport direction 500. In particular, the ink nozzles 410 more down stream along the receiver transport direction 500 need to be actuated before the ink nozzles more upstream along such a direction.

The invention has been described in detail with particular reference to certain preferred embodiments thereof, but it will be understood that variations and modifications can be effected within the spirit and scope of the invention.

PARTS LIST

10 ink jet printing apparatus
20 computer
25 control electronics
30 print bar drive electronics
31 ink jet print bar
40 ink reservoir
41 ink reservoir
42 ink reservoir
43 ink reservoir
60 receiver feed mechanism
70 receiver transport mechanism
80 ink receiver
90 platen
100 vacuum pump
105 vacuum tube
110 platen transport roller
120 receiver cutter assembly
130 receiver roll
150 receiver detection unit
190 pivot point
195 pivot point
200 motor
210 support
220 connecting rod
230 connecting link
300 base plate
400 nozzle array
401 nozzle array
402 nozzle array PARTS LIST (con't)

403 nozzle array
410 ink nozzle
420 nozzle plate
500 receiver transport direction

What is claimed is:

1. Ink jet printing apparatus for forming an ink image on a receiver having length and width in response to a digital image and for adjusting for receiver skew and image resolution, comprising:

a) at least one moveable ink jet print bar which is adapted to deliver ink to the receiver at an image transfer position to print at least a portion of a line at a time across the width of the receiver;

b) means for moving the receiver along a path past the ink jet print bar at the image transfer position;

c) detector means disposed adjacent to the path for detecting receiver skew relative to the ink jet print bar and producing a receiver skew signal representative of the receiver skew;

d) alignment means coupled to the print bar for adjusting the print bar to a position to compensate for receiver skew in response to the receiver skew signal and for adjusting the print bar position to change the image resolution; and e) control means responsive to the digital image after the ink jet print bar has been positioned for actuating the ink jet print bar to form an ink image on the receiver.

2. The ink jet printing apparatus of claim 1 wherein the detector means includes at least one image sensor for detecting an edge position of the receiver and means coupled to the image sensor for producing the receiver skew signal.

3. The ink jet printing apparatus of claim 1 wherein the ink jet print bar is pivotally mounted at a pivot position and linkage means is coupled to the ink jet print bar to rotate the print bar about the pivot position to compensate for receiver skew.

4. The ink jet printing apparatus of claim 3 wherein the linkage means includes a connecting rod pivotally mounted on the ink jet print bar and a motor responsive to the signal for translating the connecting rod to cause the print bar to rotate about the pivot position to compensate for receiver skew.

5. The ink jet printing apparatus of claim 2 wherein the image sensor is an area image sensor.

6. The apparatus of claim 1 wherein the receiver moving means includes means for applying a vacuum to the receiver to maintain a predetermined distance between the ink jet print bar and the receiver at the image transfer position.

7. The apparatus of claim 1 wherein the print bar includes a plurality of linearly distributed nozzles and wherein different nozzles deliver different colored inks to produce a colored image.

8. The apparatus of claim 1 further including cutter means for cutting the receiver to form a desired receiver size.

9. The apparatus of claim 8 wherein the receiver is a web.

10. The apparatus of claim 1 wherein the moveable print bar is pivotally mounted about a pivot position and adapted to be rotated about the pivot position and further including means coupled to the alignment means for rotating the print bar about the pivot position.

* * * * *